US012553158B1

(12) United States Patent
Jhunjhunwala

(10) Patent No.: US 12,553,158 B1
(45) **Date of Patent: *Feb. 17, 2026**

(54) WOVEN TEXTILE FABRIC

(71) Applicant: Sachin Jhunjhunwala, Maharashtra (IN)

(72) Inventor: Sachin Jhunjhunwala, Maharashtra (IN)

( * ) Notice: Subject to any disclaimer, the term of this patent is extended or adjusted under 35 U.S.C. 154(b) by 0 days.

This patent is subject to a terminal disclaimer.

(21) Appl. No.: 18/941,285

(22) Filed: Nov. 8, 2024

(30) Foreign Application Priority Data

Sep. 17, 2024 (IN) ..... 202421070089

(51) Int. Cl.

| | |
|---|---|
| ***D03D 15/20*** | (2021.01) |
| ***D03D 15/217*** | (2021.01) |
| ***D03D 15/283*** | (2021.01) |
| ***D03D 15/47*** | (2021.01) |
| *D03D 15/00* | (2021.01) |

(52) U.S. Cl.
CPC ..... *D03D 15/217* (2021.01); *D03D 15/283* (2021.01); *D03D 15/47* (2021.01); *D10B 2201/02* (2013.01); *D10B 2201/10* (2013.01); *D10B 2331/04* (2013.01); *D10B 2401/063* (2013.01)

(58) Field of Classification Search
CPC .... D03D 15/217; D03D 15/283; D03D 15/47; D10B 2201/02; D10B 2201/10; D10B 2331/04; D10B 2401/063
See application file for complete search history.

(56) References Cited

U.S. PATENT DOCUMENTS

| | | | | |
|---|---|---|---|---|
| 7,543,608 | B2 * | 6/2009 | Santens | D03D 27/02 139/116.5 |
| 9,702,064 | B2 * | 7/2017 | Goenka | D02G 3/04 |
| 10,669,651 | B2 * | 6/2020 | Gupta | D03D 15/47 |
| 11,598,047 | B2 * | 3/2023 | Holopainen | D06M 16/00 |
| 11,976,390 | B2 * | 5/2024 | Jhunjhunwala | D03D 13/004 |
| 11,982,026 | B2 * | 5/2024 | Jhunjhunwala | D03D 15/225 |
| 12,000,068 | B2 * | 6/2024 | Jhunjhunwala | D03D 1/0017 |
| 12,054,880 | B2 * | 8/2024 | Holopainen | D06M 16/00 |
| 2009/0053288 | A1 * | 2/2009 | Eskridge, Jr. | D03D 13/004 424/447 |
| 2017/0073852 | A1 * | 3/2017 | Uno | D02G 3/04 |
| 2017/0088979 | A1 * | 3/2017 | Goenka | D03D 15/49 |
| 2018/0148866 | A1 * | 5/2018 | Goenka | D03D 15/49 |
| 2022/0251738 | A1 * | 8/2022 | Sun | D03D 15/37 |
| 2022/0341064 | A1 * | 10/2022 | Kankaliya | D01D 5/26 |
| 2024/0076812 | A1 * | 3/2024 | Jhunjhunwala | D03D 1/0041 |

* cited by examiner

*Primary Examiner* — Robert H Muromoto, Jr.
(74) *Attorney, Agent, or Firm* — ROTHWELL, FIGG, ERNST & MANBECK, P.C.

(57) ABSTRACT

A woven textile fabric is provided that includes: a warp spun yarn selected from any of: 100% bamboo spun yarn or a blended yarn having at least 20% bamboo spun yarn and 0-80% cotton spun yarn, with a yarn count of 30 s to 80 s; and a 100% recycled multifilament textured polyester weft yarn with a denier of 10 D to 140 D, wherein the total content of recycled polyester in the fabric is at least about 35%, further wherein the fabric exhibits rating of 2 or above when the fabric is tested for pilling after 1000 rubs. The advantageous fabric has excellent wrinkle resistance, high tensile strength, and low pilling tendency.

6 Claims, No Drawings

WOVEN TEXTILE FABRIC

CROSS REFERENCE TO RELATED APPLICATION(S)

This application claims the benefit of Indian Patent Application No. 202421070089, filed Sep. 17, 2024, the disclosure of which is herein incorporated by reference in its entirety.

TECHNICAL FIELD

The present disclosure pertains generally to the field of textile industry. More specifically, the present disclosure pertains to a woven textile fabric with higher thread count that exhibits low pilling tendency, while being economical.

BACKGROUND

Background description includes information that may be useful in understanding the present invention. It is not an admission that any of the information provided herein is prior art or relevant to the presently claimed invention, or that any publication specifically or implicitly referenced is prior art.

Often in textile manufacturing, it becomes necessary to scrap products for one reason or another. For example, it could be that the products, once manufactured, did not meet the desired specifications, or perhaps, the product was not as marketable as anticipated. Further textiles used by the consumer are thrown into the landfills have become a big global problem. Apparel made from natural fibers takes years to decompose, whereas man-made fibers do not self-decompose. Woolen clothes do decompose but release methane and carbon dioxide into the atmosphere. This contributes towards global warming. Synthetic fabrics in the landfill release nitrous oxide which is a powerful greenhouse gas. Besides, toxic substances pollute groundwater and surrounding soil.

With increasing demand and problems associated with the decomposition of apparels, recycling and reusing textiles, fibers, and waste materials is an effective way to build sustainability in the apparel industry. Numerous recycled textile fabrics are reported in the literature and are available in market, which are used by retailers and consumers. However, these recycled textile fabrics are of low quality, non-durable, and exhibit poor elasticity, chemical resistance, tensile strength, pilling, and the likes.

There is, therefore, a need in the art to provide a new and improved textile fabric that is comfortable, breathable, wrinkle resistant, exhibits high strength and low piling that can find utility as a home textile. The present disclosure satisfies the existing needs, as well as others, and alleviates the shortcomings associated with conventional recycled fabrics.

Objects

An object of the present disclosure is to provide a woven textile fabric that overcomes the deficiencies associated with the conventional woven textile fabric.

Another object of the present disclosure is to provide a woven textile fabric that has high thread count.

Another object of the present disclosure is to provide a woven textile fabric that exhibits high tensile strength.

Another object of the present disclosure is to provide a woven textile fabric that exhibits low pilling tendency.

Another object of the present disclosure is to provide a woven textile fabric that is durable, wrinkle resistant, and comfortable to human skin.

Another object of the present disclosure is to provide a woven textile fabric that is economical and easy to manufacture.

Another object of the present disclosure is to provide a woven textile fabric that has enhanced aesthetic characteristics and can be used in a variety of applications.

Another object of the present disclosure is to provide a woven textile fabric that utilizes recycled multifilament textured polyester yarns, such as those obtained from recycling polyethylene terephthalate (PET) bottles.

SUMMARY

The present disclosure pertains generally to the field of textile industry. More specifically, the present disclosure pertains to a woven textile fabric with higher thread count that exhibits low pilling tendency, while being economical.

An aspect of the present disclosure relates to a woven textile fabric, said fabric comprising: warp spun yarn having 20-100% bamboo spun yarn with a yarn count of 30 s to 80 s; and a 100% recycled multifilament textured polyester weft yarn with a denier of 10 D to 140 D, wherein the total content of recycled polyester in the fabric is at least about 35%, further wherein said fabric exhibits rating of 2 or above when the fabric is tested for pilling after 1000 rubs. In an exemplary aspect, the warp spun yarn may further include cotton spun yarn in a range of 0-80% with the remaining being bamboo spun yarn as mentioned above.

In some embodiments, the fabric comprises 70 to 200 ends per square inch (EPI) in the warp spun yarn. In some embodiments, the fabric comprises 62 to 1300 picks per square inch (PPI) recycled multi-filament textured polyester yarns. In some embodiments, the recycled multi-filament textured polyester yarn comprises 5 to 50 filaments. In some embodiments, the fabric has a total thread count ranging from 132 to 1500. In some embodiments, the fabric is of a twill weave, a satin weave or a percale weave. In some embodiments, the recycled multi-filament textured polyester yarns are wound, substantially parallel to one another and substantially adjacent to one another, on a multi-pick yarn package at an angle between 15 and 45 degrees and at a type A shore hardness between 50 to 90 to enable simultaneous insertion of the multi-filament polyester yarns during a single pick insertion event of a pick insertion apparatus of a loom.

The woven textile fabric of the present disclosure may find utility as a bedding product, the bedding product being selected from a bed sheet, a pillow case, a comforter, a coverlet, a pillow sham, a dust ruffle, a blanket, a bedspread, and a duvet cover.

Various objects, features, aspects and advantages of the inventive subject matter will become more apparent from the following detailed description of preferred embodiments, along with the accompanying drawing figures in which like numerals represent like components.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments;

on the contrary, the intention is to cover all modifications, equivalents, and alternatives falling within scope of the present disclosure.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

Unless the context requires otherwise, throughout the specification which follows, the word "comprise" and variations thereof, such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein may be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

The expression "rating of 2 or above" as used herein throughout the present disclosure, in the context of the fabric tested for pilling after 1000 rubs, generally denotes low pilling tendency of the fabric being tested. Particularly, when the pilling tendency of the finished fabric is measured by any of the standard methods such as American Society for Testing and Materials (ASTM) Standard D4970 or International Organization for Standardization (ISO) Standard 12945-2:2014 and rated on a scale/grade/rating of 1-5, the scale/rating/grade 1 indicating very severe pilling and scale/rating/grade 5 indicating no pilling after the specified number of rubs (e.g. after 1000 rubs or cycles), the fabric exhibits a rating of 2 or 3 or 4 or 5, i.e. the woven textile fabric has low pilling tendency.

The term "woven textile fabric", as used herein throughout the present disclosure in the context of the fabric being tested for pilling tendency or pilling resistance denotes a dyed, bleached or a printed fabric, or otherwise a fabric that is substantially ready for use (e.g. consumer use) without need to be subjected to any further processing that may alter its pilling tendency or pilling resistance. For example, the raw woven fabric may be subjected to dying and/or printing and/or bleaching process(es) to produce the fabric. Such fabric is then subjected to the test for measurement of pilling resistance or pilling tendency.

In some embodiments, the numbers expressing quantities of ingredients, properties such as concentration, and so forth, used to describe and claim certain embodiments of the invention are to be understood as being modified in some instances by the term "about." Accordingly, in some embodiments, the numerical parameters set forth in the written description are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable.

The recitation of ranges of values herein is merely intended to serve as a shorthand method of referring individually to each separate value falling within the range. Unless otherwise indicated herein, each individual value is incorporated into the specification as if it were individually recited herein.

The headings and abstract of the invention provided herein are for convenience only and do not interpret the scope or meaning of the embodiments.

Various terms as used herein are shown below. To the extent a term used in a claim is not defined below, it should be given the broadest definition persons in the pertinent art have given that term as reflected in printed publications and issued patents at the time of filing.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The present disclosure pertains generally to the field of textile industry. More specifically, the present disclosure pertains to a woven textile fabric with higher thread count that exhibits low pilling tendency, while being economical.

An aspect of the present disclosure relates to a woven textile fabric, said fabric comprising: warp spun yarn having 20-100% bamboo spun yarn with a yarn count of 30 s to 80 s; and a 100% recycled multifilament textured polyester weft yarn with a denier of 10 D to 140 D, wherein the total content of recycled polyester in the fabric is at least about 35%, further wherein said fabric exhibits rating of 2 or above when the fabric is tested for pilling after 1000 rubs. In an exemplary aspect, the warp spun yarn may further include cotton spun yarn in a range of 0-80% with the remaining being bamboo spun yarn as mentioned above.

Warp spun yarn refers to the yarn used in the warp direction of a woven fabric. The warp direction runs longitudinally along the length of the fabric, parallel to the selvage. warp spun yarns are typically stronger and more durable than weft yarns because they withstand the tension and stress applied during the weaving process. These yarns are often made from materials such as cotton, bamboo, or a blend of fibers to achieve the desired properties, such as strength, elasticity, and resistance to abrasion. The yarn count of warp spun yarn may vary depending on the specific requirements of the fabric being produced, as described in the present disclosure.

The warp spun yarns may be composed of 100% bamboo spun yarn or a blend of bamboo and cotton spun yarns. In some embodiments, the warp spun yarn comprises 100% bamboo spun yarn. In an exemplary embodiment, the warp spun yarn comprises 80% bamboo spun yarn and 20% cotton spun yarn. In another alternate embodiment, the warp spun yarn comprises 20% bamboo spun yarn and 80% cotton spun yarn. In an exemplary embodiment, the warp spun yarn comprises 50% bamboo spun yarn and 50% cotton spun yarn. In an exemplary embodiment, the warp spun yarn comprises 35% bamboo spun yarn and 65% cotton spun yarn. In an exemplary embodiment, the warp spun yarn comprises 60% bamboo spun yarn and 40% cotton spun yarn. In another alternate embodiment, the warp spun yarn comprises 25% bamboo spun yarn and 75% cotton spun yarn. In an exemplary embodiment, the warp spun yarn comprises 70% bamboo spun yarn and 30% cotton spun yarn. In another alternate embodiment, the warp spun yarn comprises 40% bamboo spun yarn and 60% cotton spun yarn. In an exemplary embodiment, the warp spun yarn comprises 55% bamboo spun yarn and 45% cotton spun yarn. In another alternate embodiment, the warp spun yarn comprises 45% bamboo spun yarn and 55% cotton spun yarn. In an exemplary embodiment, the warp spun yarn comprises 30% bamboo spun yarn and 70% cotton spun yarn. In another alternate embodiment, the warp spun yarn comprises 65% bamboo spun yarn and 35% cotton spun yarn.

In further embodiments, the blended yarn may include yarns made from other materials, in addition to bamboo spun yarn and cotton spun yarn. Such materials may include, but not be limited to, hemp, linen, silk, wool, and synthetic fibers such as nylon or acrylic. For example, in an exemplary embodiment, the warp spun yarn comprises 50% bamboo spun yarn, 30% cotton spun yarn, and 20% hemp spun yarn. In another alternate embodiment, the warp spun yarn comprises 40% bamboo spun yarn, 40% cotton spun yarn, and 20% linen spun yarn. In an exemplary embodiment, the warp spun yarn comprises 60% bamboo spun yarn, 20% cotton spun yarn, and 20% silk spun yarn. In another alternate embodiment, the warp spun yarn comprises 30% bamboo spun yarn, 50% cotton spun yarn, and 20% wool spun yarn. In an exemplary embodiment, the warp spun yarn comprises 45% bamboo spun yarn, 35% cotton spun yarn, and 20% nylon spun yarn. In another alternate embodiment, the warp spun yarn comprises 55% bamboo spun yarn, 25% cotton spun yarn, and 20% acrylic spun yarn. The composition of the warp spun yarn may be selected based on the requirements (with respect to tensile strength, texture, feel, ability to retain moisture, and the like) of the use case.

In some embodiments, the warp spun yarn used in the woven textile fabric is sourced from a blend of bamboo fibers and cotton fibers (among other fiber materials). Bamboo fibers are extracted through mechanical or chemical processes, cleaned, and combed, while cotton fibers undergo ginning and carding. These fibers are then blended in specific proportions and spun into yarn using techniques like ring spinning or open-end spinning to achieve the desired yarn count and properties. The spun yarn undergoes finishing processes such as singeing, mercerizing, and dyeing to enhance its strength, luster, and color, ensuring it meets the quality standards required.

In an aspect, bamboo-based spun yarn has good antimicrobial property by its nature and the fiber is also hydroscopic, hypoallergenic and a natural deodorize. Other materials may also be blended into the bamboo-based spun yarn to enhance properties of the bamboo-based spun yarn further. For instance, blending with cotton may improve the fabric's softness and breathability, while incorporating hemp may increase its tensile strength and durability. Adding silk may provide a luxurious feel and sheen, and wool may contribute to better insulation and warmth. Synthetic fibers like nylon or acrylic may enhance elasticity and resilience, making the fabric more versatile for various applications. By combining these materials, the resulting fabric may benefit from a synergistic effect, leveraging the unique advantages of each component to create a superior woven textile fabric.

In another aspect, the bamboo-based spun warp yarn has an elongation ranging from 5-10%, tenacity cN/tex ranging from 12-17, Neps/km ranging from 5-20, and diameter (mm) ranging from 0.1 to 0.3. In an exemplary embodiment, the bamboo-based spun warp yarn exhibits an elongation of approximately 7%, a tenacity of about 15 cN/tex, Neps/km of around 10, and a diameter of approximately 0.2 mm. In another aspect, the bamboo-based spun warp yarn has an elongation ranging from 5-10%, tenacity cN/tex ranging from 12-17, Neps/km ranging from 5-20, and diameter (mm) ranging from 0.1 to 0.3. In an exemplary embodiment, the bamboo-based spun warp yarn exhibits an elongation of approximately 7%, a tenacity of about 15 cN/tex, Neps/km of around 10, and a diameter of approximately 0.2 mm.

In another exemplary embodiment, the bamboo-based spun warp yarn exhibits an elongation of approximately 6%, a tenacity of about 14 cN/tex, Neps/km of around 8, and a diameter of approximately 0.15 mm. In another exemplary embodiment, the bamboo-based spun warp yarn exhibits an elongation of approximately 8%, a tenacity of about 16 cN/tex, Neps/km of around 12, and a diameter of approximately 0.25 mm. In another exemplary embodiment, the bamboo-based spun warp yarn exhibits an elongation of approximately 9%, a tenacity of about 13 cN/tex, Neps/km of around 15, and a diameter of approximately 0.18 mm. In another exemplary embodiment, the bamboo-based spun warp yarn exhibits an elongation of approximately 8.5%, a tenacity of about 16.5 cN/tex, Neps/km of around 13, and a diameter of approximately 0.3 mm. In another exemplary embodiment, the bamboo-based spun warp yarn exhibits an elongation of approximately 9.5%, a tenacity of about 17 cN/tex, Neps/km of around 18, and a diameter of approximately 0.27 mm. In another exemplary embodiment, the bamboo-based spun warp yarn exhibits an elongation of approximately 5%, a tenacity of about 12 cN/tex, Neps/km of around 5, and a diameter of approximately 0.1 mm. These properties ensure that the yarn maintains a balance between flexibility and strength, making it suitable for various textile applications.

While any of the methods as known to or appreciated by a person skilled in the art may be used for testing of pilling resistance, particularly preferred are ASTM D4970 and ISO 12945-2. In an embodiment, the fabric exhibits rating of 2 or above when the fabric is tested for pilling for 1000 rubs in accordance with ASTM D4970. In another embodiment, the fabric exhibits rating of 2 or above when the fabric is tested for pilling for 1000 rubs in accordance with ISO 12945-2: 2014. In an embodiment, the fabric exhibits rating of 3 or above when the fabric is tested for pilling for 1000 rubs in accordance with ASTM D4970. In another embodiment, the fabric exhibits rating of 3 or above when the fabric is tested for pilling for 1000 rubs in accordance with ISO 12945-2: 2014. ASTM D4970 and ISO 12945-2 methods make use of a Martindale Tester, wherein the fabric being tested is rubbed face to face for a specified number of rubs/cycles, and the pill balls are evaluated using a photographic visual standard for comparison and given a 1-5 rating, wherein rating/grade 1 indicates very severe pilling and rating/grade 5 indicates no pilling.

In some embodiments, the warp spun yarn has a yarn count of 30 s to 70 s. In some embodiments, the warp spun yarn has a yarn count of 40 s to 80 s. In a preferred embodiment, the warp spun yarn has a yarn count of 40 s to 60 s. In another embodiment, the warp spun yarn has a yarn count of 45 s. In yet another embodiment, the warp spun yarn has a yarn count of 55 s. In a further embodiment, the warp spun yarn has a yarn count of 65 s. In some embodiments, the warp spun yarn has a yarn count of 40 s to 80 s. For example, in one embodiment, the warp spun yarn has a yarn count of 50 s. In another embodiment, the warp spun yarn has a yarn count of 60 s. In yet another embodiment, the warp spun yarn has a yarn count of 70 s. In a further embodiment, the warp spun yarn has a yarn count of 75 s.

The yarn count may be determined based on the desired properties of the woven textile fabric, such as strength, texture, and durability. Factors influencing the yarn count include the intended application of the fabric, the type of fibers used, and the required balance between softness and tensile strength. Additionally, the yarn count may be selected to optimize the fabric's performance characteristics, such as breathability, wrinkle resistance, and pilling tendency, ensuring the final product meets specific quality standards and consumer expectations.

Any conventional recycled multifilament textured polyester yarn may be used to serve its intended purpose as laid down in embodiments of the present disclosure. Preferred are recycled multifilament textured polyester yarns obtained from recycling of PET bottles. In other embodiments, the recycled multifilament textured polyester yarns may be sourced from various post-consumer and post-industrial waste materials. In some embodiments, recycled polyester yarns may be obtained from discarded fishing nets, plastic packaging, and other polyester-based waste products. In further embodiments, the recycled multifilament textured polyester yarns may be sourced from textile waste, such as discarded garments and fabric scraps from manufacturing processes. These materials may be collected, cleaned, and processed to extract polyester fibers, which are then spun into multifilament yarns. In another embodiment, the recycled multifilament textured polyester yarns may be derived from industrial polyester waste, such as off-cuts and trimmings from the production of polyester-based products like carpets, upholstery, and automotive interiors. These waste materials may be repurposed to create high-quality recycled yarns.

In yet another embodiment, the recycled multifilament textured polyester yarns may be treated with eco-friendly finishes, such as water-repellent or antimicrobial treatments, to add functional properties to the fabric. These treatments may be performed using sustainable processes that minimize water and chemical usage, aligning with the overall goal of creating an environmentally friendly textile product.

In another embodiment, the recycled multifilament textured polyester yarns may have any cross-sectional shapes, such as circular, trilobal, pentalobal, hexalobal, or octalobal. These shapes may influence the yarn's texture, luster, and overall performance characteristics. For instance, trilobal cross-sections may enhance the fabric's sheen and light reflection, making it more visually appealing. Pentalobal and hexalobal shapes may improve the yarn's bulkiness and cover factor, providing a softer and more voluminous texture. Octalobal cross-sections may increase the surface area of the yarn, enhancing its moisture-wicking properties and breathability. In some embodiments, the recycled multifilament polyester yarn has a denier of 10 D to 140 D, for example, between 20 D to 140 D, 30 D to 130 D or 40 D to 120 D. In a preferred embodiment, the recycled multifilament polyester yarn has a denier of 40 D to 120 D. In additional embodiments, the recycled multi-filament polyester yarn has a denier of 50 D to 110 D. In another embodiment, the recycled multi-filament polyester yarn has a denier of 70 D to 90 D. In further embodiments, the recycled multi-filament polyester yarn has a denier of 15 D to 135 D.

In some embodiments, the recycled multi-filament polyester yarn comprises 5 to 40 filaments. In an embodiment, the recycled multi-filament polyester yarn comprises 5 to 30 filaments. In some embodiments, the recycled multi-filament polyester yarn may be homogeneous, consisting of filaments made from the same material. In other embodiments, the recycled multi-filament polyester yarn may be heterogeneous, comprising filaments made from different materials. For example, a heterogeneous recycled multifilament polyester yarn may include a blend of recycled polyester filaments and recycled nylon filaments, enhancing the fabric's overall properties such as strength, elasticity, and durability.

In some embodiments, the recycled multi-filament polyester yarns are wound, substantially parallel to one another and substantially adjacent to one another, on a multi-pick yarn package at an angle between 15 and 45 degrees, for example, between 15 and 30 degrees or between 15 and 25 degrees, and at a type A shore hardness between 50 to 90, for example, between 60 to 80 or between 50 to 80 to enable simultaneous insertion of the multi-filament polyester yarns during a single pick insertion event of a pick insertion apparatus of a loom. In an embodiment, the recycled multifilament polyester yarns are wound, substantially parallel to one another and substantially adjacent to one another, on a multi-pick yarn package at an angle between 15 and 25 degrees and at a type A shore hardness between 50 to 90 to enable simultaneous insertion of the multi-filament polyester yarns during a single pick insertion event of a pick insertion apparatus of a loom.

In some embodiments, the total content of recycled polyester in the fabric is at least about 35%, for example, about 40% or about 50% or about 60%. In some embodiments, total content of the recycled polyester in the fabric ranges from about 35% to about 70%, for example, from about 35% to about 60%, preferably, from about 35% to about 50%, more preferably, from about 35% to about 45%, and most preferably, from about 35% to about 43%. The total proportions of the bamboo-based warp spun yarn and the recycled polyester are provided subsequently in the present disclosure.

In some embodiments, the fabric comprises 70 to 200 ends per square inch (EPI) warp spun yarns, for example, 80 to 180 ends per square inch (EPI) or 100 to 180 EPI. In some embodiments, the fabric comprises 70 to 200 ends per square inch (EPI) warp spun yarns, for example, 80 to 180 EPI or 100 to 180 EPI. In other embodiments, the fabric comprises 90 to 170 EPI warp spun yarns, for example, 95 to 160 EPI or 110 to 150 EPI. In further embodiments, the fabric comprises 75 to 190 EPI warp spun yarns, for example, 85 to 175 EPI or 105 to 165 EPI. A higher EPI indicates a denser fabric with more threads per inch, which results in a stronger and more durable textile. Conversely, a lower EPI signifies a looser weave with fewer threads per inch, which may affect the fabric's texture, flexibility, and overall strength.

In some embodiments, the fabric comprises 62 to 1300 picks per square inch (PPI) recycled multi-filament polyester yarns, for example, from 65 to 1100 PPI or from 80 to 800 PPI. In other embodiments, the fabric comprises 70 to 1200 PPI recycled multi-filament polyester yarns, for example, from 75 to 1000 PPI or from 90 to 900 PPI. In further embodiments, the fabric comprises 100 to 800 PPI recycled multi-filament polyester yarns, for example, from 110 to 700 PPI or from 120 to 600 PPI. A higher PPI indicates a denser fabric with more picks per inch, which results in a stronger and more durable textile. This increased density may enhance the fabric's resistance to wear and tear, improve its tensile strength, and provide a smoother and more uniform surface. Conversely, a lower PPI signifies a looser weave with fewer picks per inch, which may affect the fabric's texture, flexibility, and overall strength. A lower PPI may result in a softer and more breathable fabric, but it may also be less durable and more prone to pilling and other forms of wear.

In some embodiments, the fabric has a high total thread count ranging from 162 to 1500, for example, from 200 to 1200 or from 300 to 800. In other embodiments, the fabric has a total thread count ranging from 400 to 1000, for example, from 500 to 900 or from 600 to 800. In further embodiments, the fabric has a total thread count ranging from 700 to 1500, for example, from 800 to 1400 or from 900 to 1300. A higher total thread count indicates a denser and more tightly woven fabric, which generally results in a smoother and softer texture, enhanced durability, and improved resistance to wear and tear. Conversely, a lower total thread count, while still within the specified range, may result in a fabric that is more breathable and lightweight, making it suitable for applications where ventilation and moisture-wicking properties are desired, such as in summer bedding or activewear.

The EPI, the PPI, and the total thread count of the fabric may be determined/selected based on the application. For example, in applications where durability and strength are paramount, such as in upholstery or heavy-duty workwear, a higher EPI and PPI, along with a higher total thread count, would be preferred In an embodiment, the fabric is of a twill weave, a satin weave or a percale weave. In some embodiments, the fabric is of a twill weave. In some embodiments, the fabric is of a satin weave. In some embodiments, the fabric is of a percale weave. In a preferred embodiment, the fabric is of a twill weave. In an embodiment, the fabric comprises different portions that utilize different weaves. For example, one portion of the fabric may be of a twill weave, another portion may be of a satin weave, and a third portion may be of a percale weave. The combination of weaves within a single fabric may optimize its performance characteristics, making it suitable for various applications where multiple properties are required.

The advantageous fabric realized in accordance with embodiments of the present disclosure may find utility as home textiles. In some embodiments, the woven textile fabric is used as a bedding product, the bedding product being selected from a bed sheet, a pillow case, a comforter, a coverlet, a pillow sham, a dust ruffle, a blanket, a bedspread, and a duvet cover. Additionally, the fabric may be utilized in various other applications such as upholstery, curtains, tablecloths, napkins, and decorative pillow covers. The fabric may also be used in the production of apparel items like shirts, dresses, skirts, and trousers, as well as accessories such as scarves, ties, and handkerchiefs. Furthermore, the fabric may be employed in crafting reusable shopping bags, tote bags, and other eco-friendly packaging solutions. The versatility of the fabric may extend to outdoor applications, including patio furniture covers, awnings, and sunshades, owing to its durability and resistance to environmental factors.

The woven textile fabric, realized in accordance with embodiments of the present disclosure may be made by using any apparatus/loom known to a person skilled in the pertinent art. In an embodiment, fabric is produced by using a multi-pick insertion apparatus such as an air-jet or a Sulzer pick insertion apparatus. However, utilization of any other multi-pick insertion apparatus, as known to or appreciated by a person skilled in the art to serve its intended purpose as laid down in the present disclosure, is completely within the scope of the present disclosure.

Table 1 below illustrates properties of a set of fabrics, realized in accordance with embodiments of the present disclosure.

TABLE 1

| Characteristics of the Woven Fabric | | | | | | | |
|---|---|---|---|---|---|---|---|
| Sample | Recycled polyester weft (Denier) | Polyester filaments | Warp Yarn Count | Recycled polyester content (%) | Piling (1-5) | Tensile Strength (1-10) | Total Thread Count |
| 1 (Warp having 100% Bamboo spun yarn) | 20 | 14 | 60 | 45 | 2.25 | 6 | 800 |
| 2 (Warp having 100% Bamboo spun yarn) | 20 | 14 | 40 | 40 | 3 | 7 | 800 |
| 3 (Warp having 100% Bamboo spun yarn) | 25 | 14 | 40 | 45 | 2.5 | 6.5 | 800 |
| 4 (Warp having 80% Bamboo spun yarn + 20% | 20 | 14 | 60 | 45 | 2.75 | 7.25 | 800 |

TABLE 1-continued

| Characteristics of the Woven Fabric | | | | | | | |
|---|---|---|---|---|---|---|---|
| Sample | Recycled polyester weft (Denier) | Polyester filaments | Warp Yarn Count | Recycled polyester content (%) | Piling (1-5) | Tensile Strength (1-10) | Total Thread Count |
| Cotton spun yarn) | | | | | | | |
| 5 (Warp having 20% Bamboo spun yarn + 80% Cotton spun yarn) | 20 | 14 | 60 | 45 | 4 | 8 | 800 |
| 6 (Warp having 50% Bamboo spun yarn + 50%) Cotton spun yarn) | 20 | 14 | 60 | 45 | 3.5 | 7.5 | 800 |
| 7 (Warp having 50% Bamboo spun yarn + 50% Cotton spun yarn) | 20 | 14 | 40 | 35 | 4.25 | 8.4 | 800 |

It may be appreciated by those skilled in the art that the fabric described in the present disclosure may not be limited to those provided in Table 1, and the properties of the fabric may be suitably adapted based on requirements of the use case.

The fabric of the present invention exhibits a low tendency of pilling, while achieving the balance between pilling resistance and the tensile strength. Further, the fabric of the present invention is significantly economical owing to, at least, usage of recycled polyester in a considerable amount. Additionally, the fabric is durable, wrinkle-resistant, and comfortable to human skin. The fabric also addresses environmental concerns by utilizing recycled materials, thereby reducing landfill waste and the associated release of harmful greenhouse gases. The fabric's high thread count and enhanced aesthetic characteristics makes it suitable for a variety of applications, ensuring both functionality and visual appeal. Moreover, the fabric's breathability and comfort make it ideal for use in home textiles and apparel, providing a sustainable and high-quality alternative to conventional fabrics, particularly those made from recycled materials.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

Advantages

The present disclosure provides a textile fabric that overcomes the deficiencies associated with the conventional woven textile fabric.

The present disclosure provides a woven textile fabric that has high thread count.

The present disclosure provides a textile fabric that exhibits high tensile strength and low pilling tendency.

The present disclosure provides a textile fabric that is durable, wrinkle resistant, and comfortable to human skin.

The present disclosure provides a textile fabric that is economical and easy to manufacture.

The present disclosure provides a textile fabric that has enhanced aesthetic characteristics and may be used in a variety of applications.

I claim:

1. A woven textile fabric, said fabric comprising:

a warp spun yarn being selected from any of either 100% bamboo spun yarn or a blended yarn having at least 20% bamboo spun yarn and 0-80% cotton spun yarn, wherein yarn count of the warp spun yarn ranging from 30 s to 80 s; and a 100% recycled multifilament textured polyester weft yarn with a denier of 10 D to 140 D, wherein the total content of recycled polyester in the fabric is at least about 35%, further wherein said fabric exhibits rating of 2 or above when the fabric is tested for pilling after 1000 rubs.

2. The fabric as claimed in claim 1, wherein the fabric comprises 70 to 200 ends per square inch (EPI) of/in warp spun yarns.

3. The fabric as claimed in claim 1, wherein the fabric comprises 62 to 1300 picks per square inch (PPI) recycled multi-filament textured polyester yarns, and wherein the recycled multi-filament textured polyester yarn comprises 5 to 50 filaments.

4. The fabric as claimed in claim 1, wherein the fabric has a total thread count ranging from 132 to 1500.

5. The fabric as claimed in claim 1, wherein the fabric is of a twill weave, a satin weave or a percale weave.

6. The fabric as claimed in claim 1, wherein the recycled multi-filament textured polyester yarns are wound, substantially parallel to one another and substantially adjacent to one another, on a multi-pick yarn package at an angle between 15 and 45 degrees and at a type A shore hardness between 50 to 90 to enable simultaneous insertion of the multi-filament polyester yarns during a single pick insertion event of a pick insertion apparatus of a loom.

* * * * *